United States Patent [19]

Krasnov et al.

[11] 4,290,665

[45] Sep. 22, 1981

[54] METHOD OF MANUFACTURING A CONTACT CLIP

[76] Inventors: Valery A. Krasnov, Profsojuznaya ulitsa, 79, korpus 5, kv. 100; Yakov A. Klovsky, Scherbakovskaya ulitsa, 7, kv. 44.; Igor V. Dubov, 6 Parkovaya, 13, kv. 76.; Arkady V. Shtern, Veshnyakovskaya ulitsa, 27, korpus 3, kv. 130, all of Moscow; Viktor L. Vyatkin, poselok Tovarkovsky, ulitsa Kirova, 5, kv. 2., Bogoroditsk Tulskoi oblasti; Lev A. Shavelzon, ulitsa Junykh Lenintsev, 95/13, korpus 1, kv. 24, Moscow, all of U.S.S.R.

[21] Appl. No.: 78,902

[22] Filed: Sep. 25, 1979

[51] Int. Cl.[3] ..... H01R 11/08; H01R 43/02

[52] U.S. Cl. ..... 339/276 T; 29/879; 29/874; 339/278 C

[58] Field of Search ..... 29/857, 877, 879, 874; 174/74, 84 C, 94 R; 339/278 C, 275 T, 276 T; 228/263 F, 265, 173 B

[56] References Cited

U.S. PATENT DOCUMENTS

| | | | |
|---|---|---|---|
| 2,799,840 | 7/1957 | Barnes | 339/275 T |
| 2,806,215 | 9/1957 | Redslob | 339/275 T X |
| 3,233,211 | 2/1966 | Smith | 339/276 T X |
| 3,916,518 | 11/1975 | Jones et al. | 29/877 |
| 3,955,044 | 5/1976 | Hoffman et al. | 174/84 C |
| 4,163,869 | 8/1979 | Almand et al. | 174/94 R |

*Primary Examiner*—Nicholas P. Godici
*Assistant Examiner*—C.J. Arbes
*Attorney, Agent, or Firm*—Burgess, Ryan and Wayne

[57] ABSTRACT

The invention is directed to a method of manufacturing a contact clip composed of a body and a lug which is clad with a conductive coating, according to which the body and the lug are manufactured separately, the aluminium body of said contact clip being provided with a plane-parallel end portion, whereas the lug is made from an aluminium plate clad with copper so that one of the end portions thereof is left unclad, whereupon said body and said lug are butted against each other with said respective end portions thereof, and are joined together by welding. The body may be provided with a projection situated on one of the plane surfaces of the end portion thereof lengthwise the line of welding, said projection being utilized as extra metal when welding.

4 Claims, 5 Drawing Figures

METHOD OF MANUFACTURING A CONTACT CLIP

The present invention relates to methods of manufacturing predominantly bimetallic plates, in particular, to methods of manufacturing contact clips.

The present invention can find application in power and electrical-engineering industries for joining copper and aluminum current-conducting elements together.

In view of the extension of power systems the, increase in the length of power transmission lines and the increase in the number of power substations a number of urgent problems have arisen, in particular attaining higher reliability of the power construction components.

One of the most critical components of power transmission lines is a contact (instrument) clip.

At prevent a variety of methods for manufacturing contact clips are in common use.

Thus, a method of manufacturing contact clips is heretofore known to reside in press-forging of the entire clip from an aluminium bar and in attaching a copper plate to the lug thereof by virtue of welding or brazing (cf., e.g., a textbook "Insulators and fittings for aorial transmission lines" by M. M. Kaetanovich et al., Energhia Publishers, Moscow-Leningrad, 1965, pp,. 171-172 /in Russian/.

Said method, however, suffers from the disadvantages that the contact clips require much labour to manufacture by said method and prove to be inadequately reliable in operation.

High labour consumption involved in the manufacturing of the contact clips is concerned with the fact that the production technology applied, incorporates such complicated operations as blank preheating, hot-forging, drilling the holes for wire conductor, and joining the plate to the lug.

Low reliability of the clips is accounted for by the fact that the copper plate is joined to the aluminium lug at a number of points equal to the number of cold-welding punches, whereas the remaining surface is left open to an inevitable moisture penetration which in turn brings about electrochemical corrosion resulting in violent destruction of the whole joint.

Another method of manufacturing contact clips is known to consist in joining a copper contact plate to an aluminium body by virtue of butt welding (cf. "EL-PRESS Co.", Sweden). After welding the product is subject to lathe machining.

A disadvantage inherent in said method of manufacturing contact clips resides in high copper consumption, as well as in high labour requirement involved in clip production due to subsequent machining.

In addition, a method is known of manufacturing aluminium cable lugs, into which shouldered copper bushings are pressed (cf. "PFISTERER Co.", FRG).

A disadvantage of said method resides in a high labour requirement involved in the production of cable lugs, and in high copper consumption.

It is therefore a general object of the present invention to eliminate the disadvantages mentioned hereinabove.

It is a specific object of the present invention to provide a method of manufacturing contact clips that produces contact clips reliable in operation has reduced copper consumption and lower labour requirements for manufacturing a contact clip, all this being achieved due to appropriately modifying the clip production techniques.

Said object is accomplished by a method of manufacturing a contact clip which comprising a body and a lug clad with a conductive coating, according to the aluminium invention the body and the lug are manufactured separately, while the aluminium body has a plane-parallel end portion and the lug is made from a copper-clad aluminium plate so as to leave one of the lug end portion unclad, whereupon the body and the lug are joined together by welding, with said respective end portions butting against each other.

The herein-proposed method of manufacturing contact clips by welding copper-clad aluminium plates to aluminium bodies enables the quality of the product to be sharply enhanced as compared to the cold welding method and makes it possible to reduce copper consumption many times as compared to the butt welding of a copper plate and an aluminium body.

Thus, for instance, the service life of the products is extended two to ten times depending upon operating conditions, while copper consumption is reduced by a factor of several score.

The method proposed herein makes it possible to retain stability of transient resistance within the entire service life of the product due to high corrosion resistance thereof.

It is expedient that the body of the clip be provided with a projection located on one of the plane surfaces of the end portion thereof lengthwise the line of welding, and be used as extra material in welding.

This allows the welding pocess to be carried out without making use of filler wire, whereby no complex welding equipment as required, the production costs of the clips are reduced and the productivity of the process is increased.

It is useful that the body be so shaped as to provide the plane-parallel portion thereof as having the width not less than the width of the projection.

This makes it possible to stabilize heat extraction from the welding batch across the variable section of the clip body.

It is also practicalbe to dispose a certain length of the projection outside the plane-parallel portion of the body.

This affords a possibility to provide for a higher-quality welding joint when carrying the proposed method into effect.

In what follows the present invention will now be disclosed in a detailed description of specific illustrative embodiments thereof with reference to the accompanying drawings, wherein.

Figure 1:
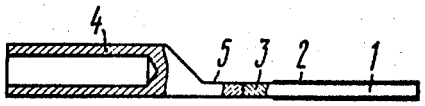
FIG. 1 illustrates a contact clip manufactured according to the method proposed herein.
Figure 2:
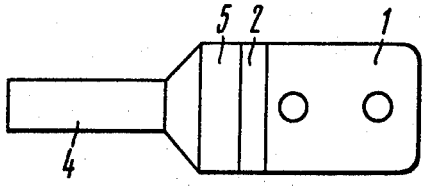
FIG. 2 is a plan view of FIG. 1.

According to the present invention the method of manufacturing a contact clip resides in that a lug 1 is shaped from aluminium (FIGS. 1 and 2) clad with a copper coating 2, whereupon part of the copper coating 2 on an end portion 3 is stripped off for a width exceeding the critical area heat-affected during welding. A body 4 of the clip is shaped from aluminium, separately and features a plane-parallel end portion 5.

Then the lug 1 and the body 4 are butted against each other with their respective end portions 3 and 5, and are weld joined with the use of a filler wire.

Figure 3:
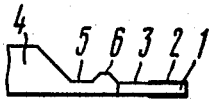
FIGS. 3 through 5 illustrate the place of the body-to-lug joint of the contact clip prepared for welding, the body of the clip being provided with a projection.

In addition, the lug 1 and the body 4 can be welded together without resorting to filler wire. To this end a projection 6 must be shaped on the plane-parallel portion 5 of the body (FIG. 3), said projection being made use of as extra metal for welding.

The plane-parallel portion 5 of the body 4 should have a width not less than the width of the projection 6, as otherwise an increased amount of metal in the middle portion of the body 4 will cause higher heat extraction, whereby the quality of the welded joint will be adversely affected.

The separate manufacture of the body 4 and the lug 1 makes the production of the contact clips less labour consuming due to a reduced mass of metal to be deformed, and makes possible press-forming without blank preheating. Application of high-quality clad material for the lug 1 extends the service life of the contact clips manufactured.

Figure 4:
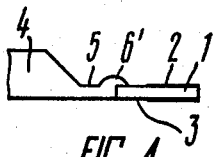
Figure 5:
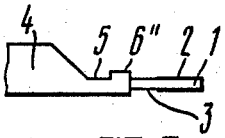

The projection 6 of the body 4 may be shaped differently, such as trapezoidal projection 6 (FIG. 3), spherical projection 6' (FIG. 4), rectangular projection 6'' (FIG. 5), and others. Another embodiment is practicable, wherein the projection 6' (FIG. 4) may protrude beyond the joint so as to stand over the lug 1.

The latter embodiment adds to the quality of the welded joint.

The contact clip manufactured according to the method proposed in the present invention, features high corrosion resistance due to high-quality copper-to-aluminium joint on the contact lug of the clip.

In addition, the method affords saving of copper due to the fact that an aluminium plate clad with copper is used rather than a solid copper plate.

What is claimed is:

1. A process for manufacturing a contact clip, comprising the steps of:

providing an aluminum body part having a planar end surface;

providing an initially separate copper-clad aluminum lug part having a copper-free planar end surface adapted to abut the planar end surface of said body part;

at least one of said parts having a projection adjacent the planar end surface thereof;

positioning said parts with said end surfaces in mutual abutment; and butt welding said parts together at said end surfaces, so that said projection flows to provide filler material for the weld.

2. A method of manufacturing a contact clip as claimed in claim 1, wherein the width of said planar end portion of said body part is not less than the width of said projection.

3. A method of manufacturing a contact clip as claimed in claim 1, wherein said projection is on said body part and partly protrudes beyond said planar end portion of said body part.

4. A contact clip manufactured by the process of claim 1.

* * * * *

UNITED STATES PATENT AND TRADEMARK OFFICE

CERTIFICATE OF CORRECTION

PATENT NO. : 4,290,665

DATED : September 22, 1981

INVENTOR(S) : Valery A. Krasnov, et al

It is certified that error appears in the above—identified patent and that said Letters Patent is hereby corrected as shown below:

Column 1, line 19: "prevent" should be --present--.

line 25: "aorial" should be --aerial--.

Column 2, line 33: "pocess" should be --process--.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*